United States Patent [19]

Okuno

[11] 4,327,836

[45] May 4, 1982

[54] PORTABLE BOTTLE STORAGE DEVICE

[76] Inventor: Benjamin T. Okuno, 405 Leota Ave., Sunnyvale, Calif. 94086

[21] Appl. No.: 78,290

[22] Filed: Sep. 24, 1979

[51] Int. Cl.[3] ..... A47F 7/28

[52] U.S. Cl. ..... 211/74; 206/162; 211/113

[58] Field of Search ..... 211/74, 113, 85, 118; 206/427, 428, 162, 164, 139; 224/45 AA, 45 BA, 45 AC

[56] References Cited

U.S. PATENT DOCUMENTS

| | | | |
|---|---|---|---|
| D. 197,146 | 12/1963 | Fisher | D6/113 |
| 2,405,517 | 8/1946 | Plummer | 206/162 |
| 2,605,000 | 7/1952 | Tomarin | 211/113 |
| 3,063,570 | 11/1962 | Kroner | 211/113 |
| 3,236,388 | 2/1966 | Ruettger | 211/113 |
| 3,387,702 | 6/1968 | Reynolds et al. | 206/162 |
| 3,628,709 | 12/1971 | Clifton | 224/45 AA |
| 3,746,179 | 7/1973 | Paumgardhen | 248/318 X |
| 3,862,687 | 1/1975 | Pirman | 211/113 X |

*Primary Examiner*—Roy D. Frazier
*Assistant Examiner*—Robert W. Gibson, Jr.
*Attorney, Agent, or Firm*—Victor R. Beckman

[57] ABSTRACT

A portable bottle storage device for storing bottles of wine, or the like, is disclosed which includes a main member comprising a sheet of plastic, cloth, or like material, and supporting means for hanging the sheet in a generally vertically extending plane. The supporting means includes an elongated rod to which the main member is secured, and a handle member in the form of a hook attached to the rod intermediate the opposite ends thereof. The hook opens toward the rear of the device, and is used for hanging the device from a closet pole, or the like. Elongated side members, which also may comprise sheets of plastic, cloth, or like material, are attached along parallel spaced lines to opposite sides of the main member to form vertically disposed and generally horizontally extending bottle-receiving pockets along opposite sides of the main member. The front edges of the side members are located rearwardly of the front edge of the main member, and elastic loops extend from the sides of the main member adjacent the front of the pockets for engagement with necks of bottles to prevent them from inadvertently slipping out of the pockets. The rear ends of the pockets are at least partially closed as by the use of straps extending between the main and side members at the rear of the pockets. The elongated pocket-forming side members may be formed of transparent material to facilitate viewing of the wine bottle labels therethrough without necessitating the removal of bottles from the pockets.

11 Claims, 3 Drawing Figures

FIG-1
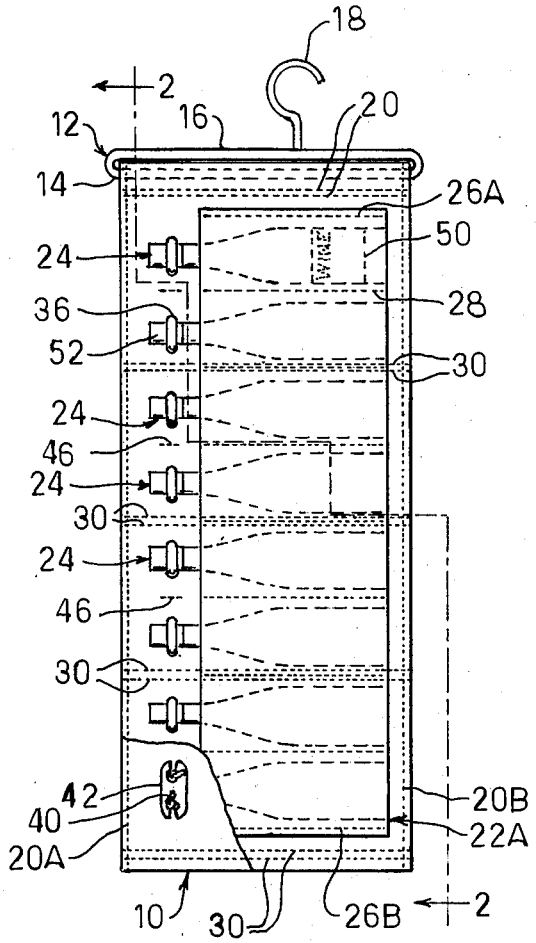
FIG-2
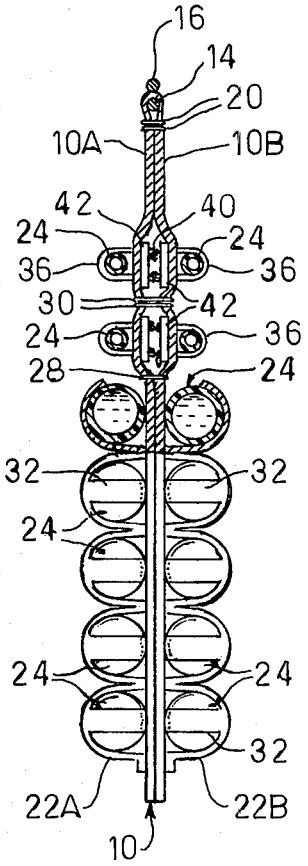
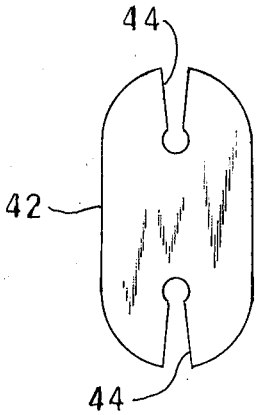
FIG-3

PORTABLE BOTTLE STORAGE DEVICE

BACKGROUND OF THE INVENTION

This invention relates to a portable bottle storage device which is particularly adapted for home storage of bottles of wine. Wine often is stored in a cool dark location, with the bottles lying on their sides to prevent drying of the cork or stopper. Wine racks of numerous designs for holding the bottles are known, including those formed of rigid material such as wood, metal, plastic, or the like, in a lattice structure for the support of one or more bottles within each of the openings therein. Generally, such structures are bulky, particularly if provision for the storage of more than several bottles is provided. Also, such storage devices often are attached to a room wall for adequate support thereof, thereby further limiting the portability thereof.

SUMMARY OF THE INVENTION AND OBJECTS

An object of this invention is the provision of a wine storage device of inexpensive, yet sturdy, design for the safe and secure storage and aging of bottles of wine.

An object of this invention is the provision of a wine storage device of the above-described type which requires no fastening thereof to room walls, or the like, and which is readily portable for transfer from one location to another while loaded with bottles of wine.

The above and other objects and advantages are achieved by use of a generally horizontally extending rod with a handle member attached thereto in the form of a hook for removable support thereof on a horizontally extending supporting member, such as a clothes closet pole, or the like. A main body member, in the form of an elongated, generally rectangular, sheet of plastic, cloth, or like material, is attached to the rod to hang vertically therefrom. Side members, also in the form of elongated sheets of plastic, cloth, or like material, are attached to opposite sides of the main body member at vertically spaced distances therealong. The side members bulge outwardly from the main member to form a plurality of bottle receiving pockets along opposite sides of the main member. The front edges of the side members are spaced rearwardly of the front edge of the main member, and elastic loops are provided on the main member adjacent the fronts of the pockets for engaging the necks of bottles supported in the bottle-receiving pockets. The rear ends of the pockets are at least partially closed to prevent bottles from passing completely through the pockets and out the rear thereof. By forming the side members of transparent material, such as colored plastic, labels of bottles contained in the pockets may be read without removing the bottles therefrom.

The invention as well as other objects and advantages thereof, will become apparent from the following detailed description when considered with the accompanying drawings.

BRIEF DESCRIPTION OF THE DRAWINGS

In the drawings, wherein like reference characters refer to the same parts in the several views:

FIG. 1 is a side elevational view of a novel portable bottle storage device embodying the present invention;

FIG. 2 is a sectional view taken substantially along line 2—2 of FIG. 1, and FIG. 3 is an enlarged side elevational view of a backing member for use in securing elastic loops to the main body sheet.

Reference now is made to FIGS. 1 and 2 wherein a preferred embodiment of the portable bottle storage device of this invention is shown comprising a main body member 10 comprising an elongated sheet of plastic, cloth, or like material, and supporting means, or hanger, 12 from which the main body member hangs. The illustrated supporting means, or hanger, 12 includes a horizontal rod 14 over which the sheet 10 extends for hanging support therefrom. The rod 14 is supported at its front and rear ends by an upper rod 16 which, in the illustrated arrangement, extends generally parallel to rod 14. The hanger also includes a handle member 18 in the form of a hook having a downwardly extending free end. The hook opens to the rear of the device to facilitate hanging and removal of the device, from, say, a closet pole. The member also serves as a handle for transporting the device.

The illustrated main body member 10 comprises an elongated sheet which is folded over the rod 14 at the center of the sheet to form a double layer member which includes right and left main body sections 10A and 10B, respectively. The sections 10A and 10B are attached together adjacent the rod 14 as by stitching 20 to form a loop of material about the rod for securing the member to the rod. Also, stitching 20A, and 20B along the front and rear edges, respectively, of the main body 10 secure a hem, not shown, provided along such edges. Hem stitching 20A and 20B does not serve to secure the main body layers 10A and 10B together.

Elongated right and left side members 22A and 22B comprising sheets of flexible plastic, cloth, or like material, are provided at opposite sides of the main body 10, to form a series of vertically disposed pockets along opposite sides of the main body member for the support of bottles 24 of wine, or the like, within such pockets. The illustrated side sheets 22A and 22B are located directly opposite each other, and are attached to the main sheet 10 as by stitching, adhesive, heat sealing, or the like, along lines 26A and 26B along the upper and lower ends thereof, respectively, and along parallel spaced lines 28 intermediate the upper and lower ends. The length of side sheet material between attachment lines exceeds that of the main panel such that the side sheets bulge outwardly from the main panel for formation of the bottle-carrying pockets therewith. Although wine bottles differ in dimensions, many have a diameter on the order of 3 to 3¼ inches. For many uses, jackets of a size to accommodate bottles up to a diameter of, say, 3½ would be satisfactory. Obviously, the invention is not limited to such dimensions. Several rows of double stitching 30 are shown extending along several of the stitch lines 28 and across the entire width of the main panel sections 10A and 10B for added strength, and one row of double stitching 30 is shown adjacent the bottom edge of the main body 10.

The side sheets 22A and 22B are of smaller width than the main sheet 10, and are disposed toward the rear thereof, rather than down the center of the main body sheet. The width of the side sheets is less than the height of bottles 24 such that the bottle necks extend forwardly from the front of the pockets for use in grasping the same for insertion and removal thereof from the pockets. For purposes of illustration, and not by way of limitation, a main sheet 10 having a finished width of 17 inches and length of 37 inches may be employed, together with side sheets 22A and 22B having a width of 10 inches and of sufficient length to provide for the above-described pockets. The side sheets 22A and 22B may be spaced 1 and 6 inches from the rear and front edges, respectively, of the main sheet 10. The rear of the bottle-holding pockets are at least partially closed to prevent bottles from passing therethrough. In the illustrated arrangement, straps 32 (see FIG. 2) integrally formed with the side sheets extend between the main and side sheets at the rear end of the pockets to partially close the same. Stitching, adhesive, or like means, not shown, may be used for attaching the ends of straps to the main members. Obviously, separate rather than integrally formed straps 32 may be used, if desired.

Another feature of the present invention includes the use of elastic loops 36 at opposite sides of the main sheet 10 adjacent the front of the pockets for partially encircling the necks of the bottles 24 for securely maintaining the bottles within the pockets and preventing inadvertent slippage therefrom as, for example, when transporting the device from one location to another. The ends of the elastic members 36 extend through spaced apertures in the sections 10A and 10B of the main sheet 10, and are knotted, as at 40, at the inner ends thereof. Reinforcement, or backing, plates 42 of solid plastic material, or the like, are provided for each elastic loop member 36 to prevent the knotted end thereof from pulling through the main sheet walls. As best seen in FIG. 3, the reinforcement plates 42 may be formed with keyhole shaped slots 44 adjacent opposite edges thereof into which the opposite ends of the elastic members may be inserted, with the knots 40 at the inner faces thereof. Typical overall dimensions for plates 42 may range from, say, 1"×2" to 1½"×2½". Obviously, other means for preventing the elastic loops 36 from tearing through the main sheet-sections 10A and 10B may be provided, if desired. It will be apparent that once the bottles 24 are inserted into the pockets and the elastic loops 36 placed over the bottle necks, the bottles are securely maintained within the pockets. Typical wine bottles range in height from approximately 13 to 14½ inches. The elastic loops 30 may be located approximately 2 inches from the front edge of the side sheets 22A and 22B to accomodate bottles of different height which extend different distances from the pockets. Again, such dimensions are by way of illustration, and not limitation. Also, short lines of stitching 46, or like securing means, are provided between pairs of the elastic loops 36 to secure the main sheet sections 10A and 10B together thereat to prevent excessive bulging between sheets when the device is loaded with bottles.

It here will be noted that the supporting hook 18 is located rearwardly of the center of the horizontal supporting rod 14, above the approximate vertical center plane through the pockets. With this arrangement, the center of gravity of the bottles 24 is disposed, generally, in a vertical plane extending through the hook 18 whereby the bottle loaded device hangs substantially vertically. Such location and orientation of the pockets not only provides for such balance, but the forward-facing pocket openings also facilitate removal and insertion of bottles into the device, particularly when the device is hung in a closet, or other such place, which normally is accessible only from the front.

Preferably, the main body, or sheet 10, of the device is formed of opaque material to conceal the inner knotted ends 20 of the elastic loops and the associated reinforcement plates 42. The outer side members, or sheets 22A and 22B, on the other hand, preferably are formed of transparent material to facilitate reading of the bottle labels therethrough. As seen in FIG. 1, a label 50 for the upper-most bottle 24 at the right side of the device is readily visible through the illustrated plastic side member 22A. Preferably, a tinted, or colored, plastic material is employed rather than, say, clear plastic to limit light-transmission therethrough, for protection of the wine, while allowing for reading of the bottle labels. Of course, the neck seals 52, normally included on the wine bottles, also are readily visible with the present arrangement.

The invention having been described in detail in accordance with the requirements of the United States Patent Statutes, various changes and modifications will suggest themselves to those skilled in this art. For example, it will be apparent that the number of pockets provided may differ from the illustrated sixteen pocket device. Also, the pockets may be formed using a plurality of side sheets at each side of the main sheet, rather than a single sheet at each side, as illustrated. If desired, the pockets may be grouped, as for example, adjacent the upper and lower ends of the main body, or sheet 10, with a space therebetween to allow for folding of the device across the middle thereof to facilitate transporting the device when loaded with bottled. However, it will be apparent that with the illustrated arrangement, bottles adjacent the vertical center of the opposite rows thereof may be removed to allow for such folding. In addition, as noted above, a single layer main sheet may be employed in place of the illustrated double-layer sheet 10. Also, the side sheets may be attached to the main sheet along parallel inclined lines to provide for pockets which incline downwardly toward the rear thereof. However, the angle of inclination is not so great as to avoid contact of the contents of the bottles with the cork or stopper closing the end thereof. The elastic neck straps may be eliminated from the structure, particularly where the pockets are so inclined to the horizontal. The use of the term generally horizontal pockets, or the like, is intended to include both the illustrated horizontal pocket arrangement, and arrangements wherein the pockets incline downwardly toward the rear thereof. Also, it will be apparent that different size pockets may be provided to accomodate different size bottles. It is intended that the above and other such changes and modifications shall fall within the spirit and scope of the invention as defined in the appended claims.

I claim:

1. A portable storage device for the storage of bottles of wine, or the like, on their sides, said device comprising a main member comprising a sheet of flexible material, supporting means for hanging support of said main member in a generally vertical plane, said supporting means including spaced upper and lower rigid horizontally extending rods interconnected at front and rear ends thereof to form a closed loop, a portion of said main member extending over the lower rod for hanging support of the main member therefrom, and side members comprising sheets of flexible material attached to opposite sides of said main member and forming generally horizontally extending container-carrying pockets with said main member at opposite sides thereof for the storage of bottles, or the like, in a generally horizontal position therewithin, said supporting means also including a hook attached to said upper rod intermediate the opposite ends of said upper rod for hanging support of the device, said hook being positioned above said container-carrying pockets at a vertical plane extending substantially through the center of the pockets, said hook and container-carrying pockets being offset from the vertical center of the main member toward the rear thereof.

2. A portable storage device for storage of bottles of wine, or the like, on their sides, said device comprising a main member comprising a sheet of flexible material, supporting means for hanging support of said main member in a generally vertical plane, said supporting means including a rigid horizontally extending rod over which a portion of said main member extends for hanging support of the main member, said supporting means also including a hook attached to said rod intermediate the opposite ends of the rod for hanging support of the device, and side members comprising sheets of flexible material attached to opposite sides of said main member and forming generally horizontally extending container-carrying pockets with said main member at opposite sides thereof for the storage of bottles, or the like, in generally horizontal position therewithin, said hook being positioned above said container-carrying pockets at a vertical plane extending substantially through the center of the pockets, said hook and container-carrying pockets being offset from the vertical center of the main member toward the rear thereof.

3. A portable storage device as defined in claim 2 wherein said main member comprises right and left sections secured together in back-to-back position.

4. A portable storage device as defined in claim 3 wherein said main member comprises a single sheet of flexible material folded adjacent the center thereof to form said right and left sections thereof.

5. A portable storage device as defined in claim 4 wherein said supporting means comprises a rigid horizontally extending rod over which the fold in the main member extends for hanging support of the main member from the rod.

6. A portable storage device for the storage of bottles of wine, or the like, on their sides, said device comprising a main member comprising a sheet of flexible material, supporting means for hanging support of said main member in a generally vertical plane, side members comprising sheets of flexible material attached to opposite sides of said main member and forming generally horizontally extending container-carrying pockets with said main member at opposite sides thereof for the storage of bottles, or the like, in a generally horizontally position therewithin, said side members being of smaller width than said main member, and being positioned a spaced distance from the front edge of the main member, and elastic loops extending from opposite sides of the main member adjacent the front of the pockets for engaging necks of bottles supported in the pockets to maintain the bottles in the pockets.

7. A portable storage device as defined in claim 6 including, means at the rear of the pockets for preventing passage of bottles through the rear ends of the pockets.

8. A portable storage device as defined in claim 7 wherein said means at the rear of the pockets comprises straps extending between the main and side members at the rear of the pockets.

9. A portable storage device as defined in claim 6 wherein said side members are transparent for viewing bottles contained in the pockets therethrough.

10. A portable storage device as defined in claim 6 wherein said side members are attached to said main member along parallel spaced lines of attachment at vertical spaced distances down opposite sides of the main member.

11. A portable storage device as defined in claim 10 wherein an equal number of container carrying pockets are formed at opposite sides of the main member, which pockets are located directly opposite each other.

* * * * *